United States Patent [19]

Bogage

[11] Patent Number: 5,072,658

[45] Date of Patent: Dec. 17, 1991

[54] INSTALLATION OF AIR CURTAINS

[76] Inventor: Gerald I. Bogage, 2000 NW. 95th Ave., Miami, Fla. 33172

[21] Appl. No.: 695,391

[22] Filed: May 3, 1991

[51] Int. Cl.[5] ..... F24F 9/00

[52] U.S. Cl. ..... 454/188

[58] Field of Search ..... 98/36

[56] References Cited

U.S. PATENT DOCUMENTS

| | | | |
|---|---|---|---|
| 3,215,058 | 11/1965 | Anderson | 98/36 |
| 3,229,609 | 1/1966 | Larson et al. | 98/36 |
| 3,294,006 | 12/1966 | Berner et al. | 98/36 |
| 3,327,935 | 6/1967 | Berlant | 98/36 X |
| 3,362,469 | 1/1968 | Berner et al. | 98/36 |
| 3,396,651 | 8/1968 | Kamiya et al. | 98/36 |
| 3,827,862 | 8/1974 | Berlant | 98/36 X |

*Primary Examiner*—Harold Joyce

*Attorney, Agent, or Firm*—Anthony A. O'Brien

[57] ABSTRACT

A modular installation of a plurality of air curtains is disclosed as including a cabinet for each air curtain housing a blower and motor and having opposed end panels with fastening means securing adjacent cabinets to each other whereby cabinets of the same or different lengthwise dimensions may be installed as a unitary device.

9 Claims, 2 Drawing Sheets

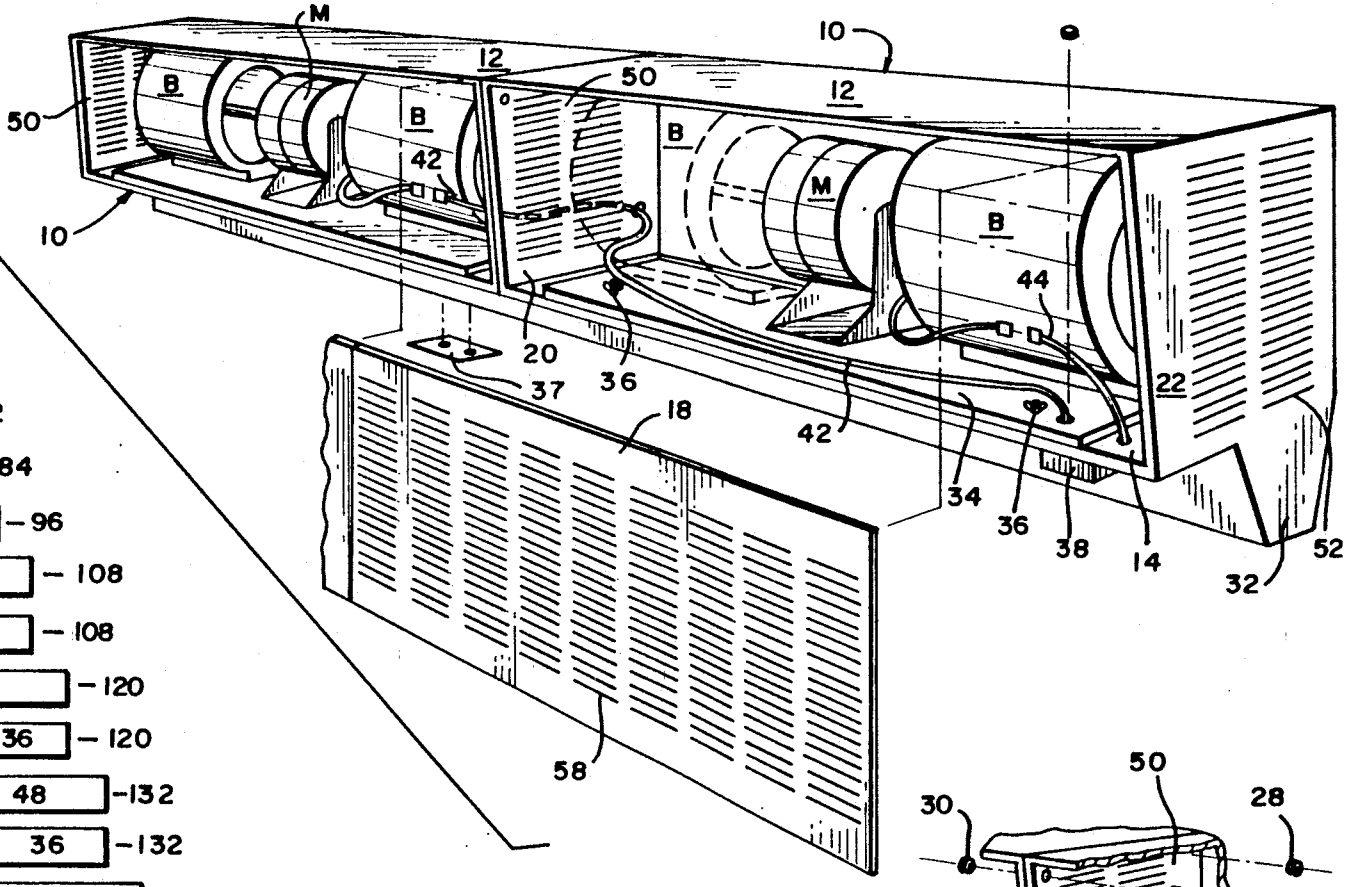
FIG. 1
FIG. 2
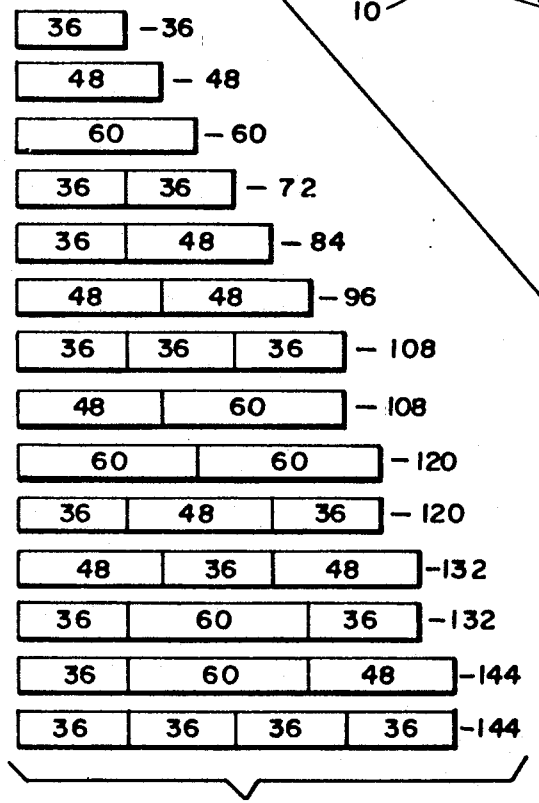
FIG. 3

INSTALLATION OF AIR CURTAINS

FIELD OF INVENTION

The present invention relates to air curtains providing a curtain of air in a building opening to act as an air separator or air barrier between the interior and exterior environments of the building.

BACKGROUND OF INVENTION

Air curtains are well known in the art which is exemplified by U.S. Pat. Nos. 3,294,006, 3,327,935 and 3,362,469. It should be noted the prior art air curtain devices are subject to many disadvantages, some of which are shipping limitations as to weight and size, stock requirements needed to house large sizes for accommodation of different and large sized building openings, and lack of installation considerations regarding air flow and electrical wiring.

OBJECTS OF THE INVENTION

It is the object of the present invention to improve the prior art air curtains by facilitating installation thereof.

This invention has another object in that air curtains are constructed in modular form.

Another object of this invention is to arrange a plurality of air curtain cabinets in modular form whereby a plurality of units may be installed at a single installation, which installed units are individually smaller than the size of the opening in a building.

This invention has a further object in that a substantial economic benefit is achieved by constructing modular air curtain cabinets in such a manner as to permit abutting connection between a plurality of installed cabinets.

SUMMARY OF THE INVENTION

The present invention is summarized in an installation for air curtains including a plurality of air curtains each having a hollow cabinet adapted to house a motor and a blower, each cabinet having widthwise and lengthwise dimensions with the lengthwise dimension being larger than the widthwise dimension, each cabinet also having a pair of opposed end panels, and attachment fasteners attaching said end panels of adjacent cabinets permitting the plurality of air curtains to be attached in a modular arrangement.

Other objects and advantages of the invention will become apparent from the following description taken in conjunction with the accompanying drawing.

BRIEF DESCRIPTION OF THE DRAWINGS

FIG. 1 is a diagrammatic perspective view of an air curtain installation embodying the present invention;

FIG. 2 is a partial cross sectional perspective view as looking in the direction of the arrows 2—2 in FIG. 1;

FIG. 3 is a block diagram of different sizes and combinations of interchangeable air curtain cabinets;

DETAILED DESCRIPTION

Figure 4:
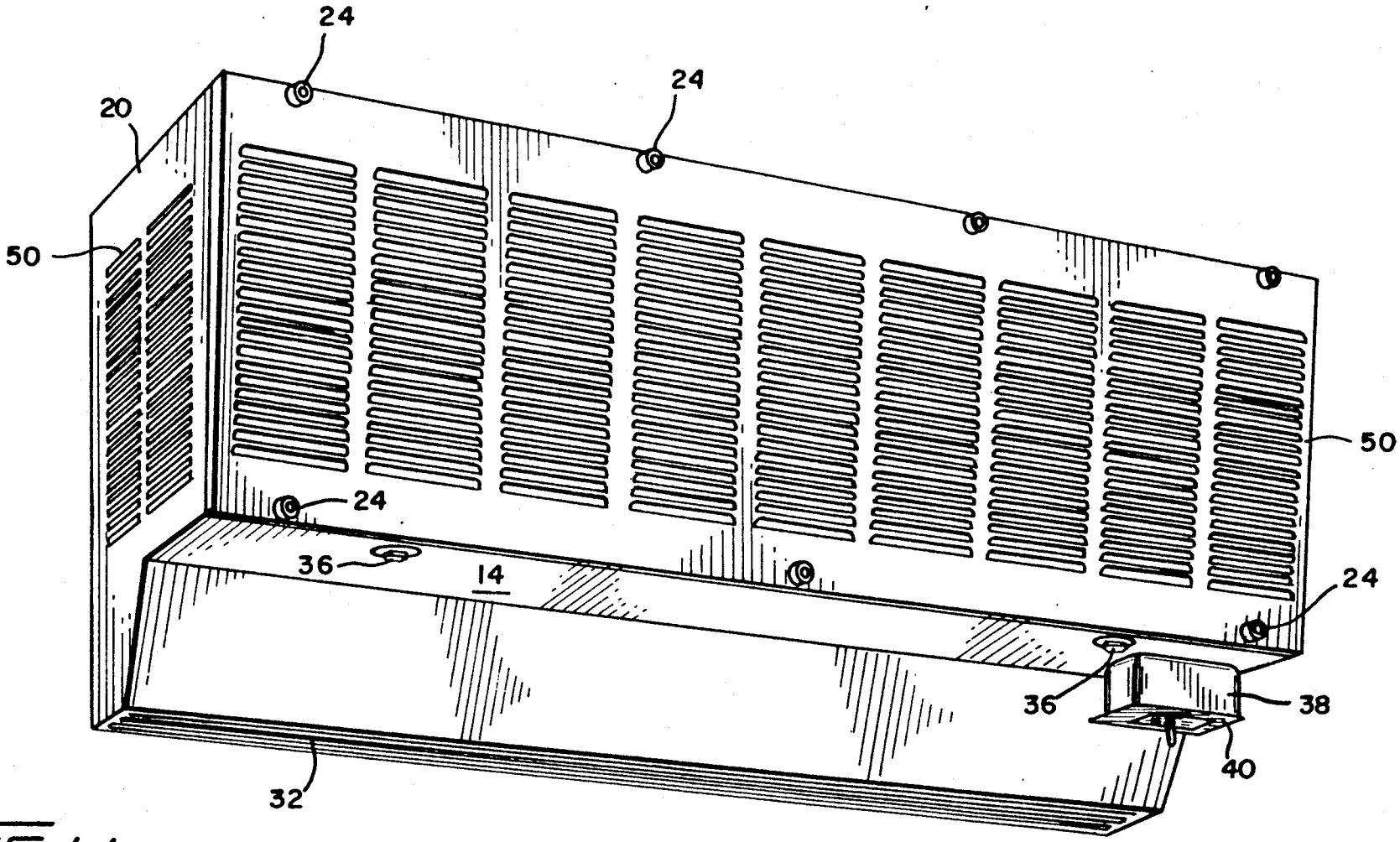
FIG. 4 is a perspective view of FIG. 4 showing a single air curtain cabinet in assembled form.

The present invention as illustrated in FIG. 1 embodies an air curtain cabinet, indicated generally at 10. As is known in the art, an air curtain device provides a cooled or heated curtain of air which acts as an air barrier or separator repelling outside air and maintaining interior environment. A modular installation for air curtain cabinets 10 is shown in FIG. 3 where the lengthwise dimensions of the air curtain cabinets are determined by the width of an opening in which the cabinet is to be mounted, such as a retail store, a warehouse, a factory, etc. The most common sizes are 36, 48, 60, and 72 inches in lengthwise dimensions. Whenever an installation requirement called for a lengthwise dimension that was different from the common stock sizes, it was necessary to order from the factory an odd sized cabinet resulting in extra cost and delay in installing the odd sized cabinet. Because of the cost involved, the supplier has found it to be very expensive to carry a large supply of a variety of odd sizes.

As is shown in FIG. 1, each cabinet 10 includes spaced top and bottom walls 12 and 14, a rear wall 16 and a removable front wall 18. A left side panel 20 and right side panel 22 are integrated with walls 12, 14 and 16 to form a hollow-like cabinet. The front wall 18 is removably secured to the front edges of the top and bottom walls 12 and 14 and of the two side panels 20 and 22 as by a plurality of spaced fastening means, such as screws fixed to the front edge and knurled nuts 24 (see FIG. 4). Each of the two panels 20 and 22, includes a knockout disc 26 with the disc 26 of one panel 20 being in axial alignment with the disc 26 of the second panel. As shown in FIG. 2, each panel 20 (22) also has four knockout discs 28 disposed in the vicinity of the four corners of the panel 20 (22); each knockout disc 28 is replaced with a cap screw 30 or the like to fasten together the two panels 20 and 22 of adjacent cabinets 10 which then appear as a single unit.

The lower portion of rear wall 16 as best seen in FIG. 4 and the rearmost portion of bottom wall 14 combine to define an air expulsion vent through an outlet nozzle 32.

A support plate 34 is disposed on the inside surface of the bottom wall and is securely fastened thereto as by cap screws and wing nuts 36. The support plate 34 carries two blowers B and a motor M for driving the two blowers. A cover plate 37 is removable from the bottom wall 14 to be replaced with a pre-wired junction box 38 located on the exterior surface of the bottom wall 14 which is provided with spaced apertures for electric lines from the junction box. A two speed high/-low switch 40 is mounted the junction box 38 for manual operation. A pair of electric lines extends from the junction box 38. One line 42 extends through the opening left by knockout discs 26 and into the adjacent cabinet 10 where it is connected to the motor M when 2 cabinets are used; the other line 44 extends directly into the first cabinet 10 where it is connected to the motor M therein.

Each side panel 20 is provided with two spaced rows of louvers 50 as shown in FIG. 4. Similarly, each side panel 22 has two rows of louvers 52 as shown in FIG. 1 and 2. The alignment of louvers 50 with the louvers 52 results in the particular advantage that air may flow from one cabinet 10 to and from an adjacent cabinet 10. Such an arrangement results in a more even air distribution between adjacent cabinets which share common air because of the abutting construction between end panels.

The front wall 18 of each cabinet 10 includes a plurality of spaced rows of louvers 58, the actual number of the rows varying according to the width of the cabinet 10. As is illustrated in FIG. 4, the number of rows total 9 and each row is equally spaced from the adjacent row.

Furthermore, the space between the end row and the front edge of the side panel 20 (22) is approximately one-half that of space between adjacent rows. When a plurality of cabinets 10 are mounted adjacent each other, the front walls 18 present an appearance of a continuous front wall so the number of cabinets 10 are not readily apparent. This aesthetic enhancement is further enhanced when only one junction box 38 is utilized because the cover plates on the other cabinets are not removed.

The prior art air curtain cabinets are manufactured in a variety of specific width sizes, for example, 36, 48, 60, 72, 84, 108 inches as well as many other sizes. Such units are built one at a time on an on order basis and are available in various horsepower motor and blower wheels resulting in specific feet per minute and cubic feet per minute air delivery. In those cases where an oversized cabinet is needed, the manufacturer faces a further problem of increased shipping costs and being limited to some shipping companies. For example, at least one shipping company will not accept any matter over sixty inches in size.

The present invention achieves a modular design by the use of flush end panels 20 and 22 being bolted together, uniform intake grille design for uniform air intake and appearance regardless of size of the unit, uniform intake opening to conform to all various motor sizes, and hidden knockout discs to permit option of using as a single unit or a multiple unit and to allow the electric wire from one unit to be pulled through other units to the single control junction box. Also by limiting the single cabinet maximum size to sixty inches, sagging in the middle is prevented when joined to other units.

FIG. 3 shows some of the probable arrangements of cabinet unit sizes according to the present invention. The three basic lengthwise unit sizes are 36, 48, and 60 inches which may be used individually or may be combined as further shown in FIG. 3. For example, the most common combinations are found in the following chart:

72 inches—2 units of 36
84 inches—1 unit of 36 and 1 unit of 48
96 inches—2 units of 48
108 inches—3 units of 36
108 inches—1 unit of 48 and 1 unit of 60
120 inches—2 units of 60
120 inches—2 units of 36 and 1 unit of 48
132 inches—2 units of 48 and 1 unit of 36
132 inches—2 units of 36 and 1 unit of 60
144 inches—1 unit each of 36, 48 and 60
144 inches—4 units of 36

From the above chart and FIG. 3 of the drawing, it is apparent that 72, 96, 108 (1st), 120 (1st), and 144 (2nd) inch units combine a plurality of units equal in lengthwise size while 84, 108 (2nd), 120 (2nd), 132 (1st and 2nd) and 144 (1st) inch units combine a plurality of units equal and unequal in lengthwise. Of course, other combinations of the 3 common sizes of 36, 48 and 60 may be utilized in those installatins having unusual or special requirements.

In addition to the combined sizes listed in the above chart, other lengthwise size combinations may be constructed for use in different sizes of building openings. By way of example, a 38 inch unit may be combined as follows:

74 inches—1 unit of 36 and 1 unit of 38
76 inches—2 units of 38
86 inches—1 unit of 38 and 1 unit of 48
110 inches—2 units of 36 and 1 unit of 38
112 inches—2 units of 38 and 1 unit of 36
124 inches—2 units of 38 and 1 unit of 48
134 inches—2 units of 48 and 1 unit of 36
136 inches—2 units of 38 and 1 unit of 60
146 inches—1 unit each of 38, 48 and 60
148 inches—2 units of 36 and 2 units of 38

If desired, similar combinations could be made using a small basic cabinet such as a 30 inch unit.

From the foregoing, it is apparent that the modular construction of air curtain devices according to the present invention provide a wide variety of options for installation of the devices. A principal feature of this modular arrangement is that a supplier of these air curtain devices need only stock the commonly used sizes as represented by the 36, 48 and 60 inch lengthwise cabinet dimensions.

Each cabinet is individually mounted on a vertical support by means of any suitable brackets (not shown) on the exterior of the rear wall 16. The construction lends itself to be installed by a single person inasmuch as the hollow cabinet is first mounted on the support, then the support plate 35 with the blowers and motor thereon is inserted onto the bottom wall 14 and secured thereto by wing nut and bolts 36. A second cabinet 10 may then be mounted on the vertical support and secured to one of the end panels, and a third cabinet 10 to one of the two exposed end panels, and similarly a fourth cabinet 10.

Inasmuch as this invention is subject to many modifications, variations and changes in detail, it is intended that all matter contained in the foregoing description or shown on the accompanying drawings shall be interpreted as illustrative and not in a limiting sense.

I claim:

1. An installation for an air curtain comprising a hollowlike cabinet adapted to house motor and blower means, each cabinet having a pair of opposed panels and an access wall extending between said panels, louvers in said access wall and in said panels for air flow into said cabinet, each panel having a plurality of knockout discs spaced from each other and adapted to be displaced and receive fastening bolts whereby said cabinet may be fastened to an adjacent cabinet.

2. An installation for an air curtain comprising a cabinet having top and bottom walls, rear wall disposed between rear portions of said top and bottom walls, a removable front wall disposed between front portions of said top and bottom walls, a first side panel mounted on one end of said walls, a second side panel mounted on the other end of said walls, said top, bottom, rear and front walls together with said panels define an enclosure adapted to house motor and blower means, louver means on said front wall and said first and second panels whereby air flows into said enclosure, air outlet means on said bottom wall whereby air flows out of said enclosure, a plurality of knockout discs in said first panel adapted to be replaced with fastening means whereby a similar adjacent cabinet may be attached to said cabinet, and a plurality of knockout discs in said second panel adapted to be replaced with fastening means whereby another similar adjacent cabinet may be attached to said cabinet.

3. An installation for an air curtain as claimed in claim 2 wherein each panel has a knockout portion and said cabinet has a knockout section, and electric wire means extends through said knockout section into cabinet and thence out thereof through said knockout portion and thus into an adjacent cabinet.

4. A modular installation for air curtains comprising a plurality of air curtains adapted to be attached to a vertical support, each having a hollow-like cabinet adapted to house motor and blower means, each cabinet having a lengthwise dimension and a widthwise dimension with the lengthwise dimension being larger than the widthwise dimension, each cabinet having a pair of opposed end panels, means attaching said end panels of adjacent cabinets whereby the plurality of air curtains are attached in a modular arrangement, air intake means on each cabinet and on its end panels to permit air to flow into each cabinet, and air outlet means on each cabinet to permit expulsion of air from each cabinet.

5. A modular installation for air curtains as claimed in claim 4 wherein said plurality of air curtains includes a plurality of cabinets being equal to each other in their lengthwise dimension.

6. A modular installation for air curtains as claimed in claim 4 wherein said plurality of air curtains includes a plurality of cabinets being unequal to each other in their lengthwise dimensions.

7. A modular installation for air curtains as claimed in claim 4 wherein said plurality of curtains includes two cabinets of unequal lengthwise dimensions.

8. A modular installation for air curtains as claimed in claim 4 wherein said plurality of curtains includes three cabinets of equal lengthwise dimensions.

9. A modular installation for air curtains as claimed in claim 4 wherein said plurality of curtains includes three cabinets of unequal lengthwise dimensions.

* * * * *